US008763277B2

(12) United States Patent
Sartor

(10) Patent No.: US 8,763,277 B2
(45) Date of Patent: Jul. 1, 2014

(54) FOOTWARE WITH SHOCK ABSORBING SOLE

(75) Inventor: Adriano Sartor, Montebelluna (IT)

(73) Assignee: Stonefly S.p.A., Treviso (IT)

( * ) Notice: Subject to any disclaimer, the term of this patent is extended or adjusted under 35 U.S.C. 154(b) by 704 days.

(21) Appl. No.: 13/034,498

(22) Filed: Feb. 24, 2011

(65) Prior Publication Data

US 2011/0203134 A1 Aug. 25, 2011

(30) Foreign Application Priority Data

Feb. 25, 2010 (EP) ..... 10154631

(51) Int. Cl.
*A43B 13/20* (2006.01)

(52) U.S. Cl.
USPC ..... 36/59 R; 36/25 R; 36/28

(58) Field of Classification Search
USPC ..... 36/25 R, 28, 29, 59 R, 59 C
See application file for complete search history.

(56) References Cited

U.S. PATENT DOCUMENTS

| | | | | |
|---|---|---|---|---|
| 4,161,828 | A * | 7/1979 | Benseler et al. | 36/32 R |
| 5,768,802 | A * | 6/1998 | Bramani | 36/28 |
| 6,018,889 | A * | 2/2000 | Friton | 36/28 |
| 6,082,024 | A * | 7/2000 | Del Biondi | 36/28 |
| 6,516,540 | B2 * | 2/2003 | Seydel et al. | 36/29 |
| 6,701,642 | B2 * | 3/2004 | Hay | 36/59 C |
| 7,073,275 | B2 * | 7/2006 | Hay | 36/25 R |
| 7,200,955 | B2 * | 4/2007 | Foxen | 36/25 R |
| 7,313,875 | B2 * | 1/2008 | Morgan | 36/59 C |
| 7,784,196 | B1 * | 8/2010 | Christensen et al. | 36/29 |
| 8,220,182 | B2 * | 7/2012 | Righetto | 36/28 |
| 2004/0194343 | A1 * | 10/2004 | Kim | 36/29 |
| 2005/0241185 | A1 | 11/2005 | Flood et al. | |
| 2005/0268490 | A1 | 12/2005 | Foxen | |
| 2007/0277401 | A1 * | 12/2007 | Young-Chul | 36/30 R |

* cited by examiner

*Primary Examiner* — Marie Bays
(74) *Attorney, Agent, or Firm* — Tutunjian & Bitetto, P.C.

(57) ABSTRACT

A shoe including cushioning elements housed in a tread sole adapted to come into contact with the ground, the cushioning elements including a plurality of cushioning capsules orientated in a manner such that they substantially follow a line on which the weight of a person is transferred during walking, that is, a podalic line; the cushioning capsules have different sizes and shapes that are geometrically similar to each other, constituting a series of modular elements adaptable to every shoe size and type.

19 Claims, 8 Drawing Sheets

FOOTWARE WITH SHOCK ABSORBING SOLE

CROSS-REFERENCE TO RELATED APPLICATION

This application claims priority under 35 USC §119 to European Patent Application serial number EP 10154631.5, filed on Feb. 25, 2010, the entire disclosure of which is hereby incorporated by reference.

TECHNICAL FIELD OF THE INVENTION

The present invention refers to a shoe equipped with a sole, and/or other portions, that are cushioning.

The present invention also relates to a cushioning system of modular type comprising one or more base cushioning elements in the form of capsules with different sizes, but with shapes geometrically similar to each other. Such capsules are adapted to achieve a modular system of cushioning elements to be applied to the soles of all shoe types and are capable of defining, by means of a reduced number of elements, predetermined body load distribution lines on such soles.

DESCRIPTION OF RELATED ART

In the field of valuable footwear, soles can be equipped with cushioning inserts for improving walking comfort. These inserts are often chambers filled with liquid, air, gel or similar materials which, upon deformation, dampen the impact of the foot against the ground and/or mitigate impact hardness. Therefore, such inserts reduce the mechanical stress which acts on the foot.

A further improvement, e.g. present in the patent applications US2005/0241185 and US2005/0268490, is to place the inserts in the sole tips, which are stressed in larger extent. Indeed, biomechanics teaches that during pronation, the sole of the foot touches the ground along a line, called podalic line, visible for example in FIG. 1 of US-2005/0241185.

In US-2005/0241185, a chamber 38 is described, filled with fluid, which is extended approximately to the center of the sole and is enlarged beneath the metatarsus, zone 47.

Inside the chamber, a rigid element is present, called island 40. After walking, the fluid can be moved inside the chamber by moving around the island 40, and it follows the natural cycle of the pace. The rigid island 40 limits the comfort of the sole, and the chamber 38 is not sufficiently curved to be able to adequately follow the podalic line—without the constriction of its inner channels, which would prevent the fluid displacement.

In US-2005/0268490, inserts 40 of various shapes are described. These are made of polyurethane foam and are set in areas along the podalic line. The inserts are contained in seats of an insole, which lies on a tread sole 50. The latter is provided with projections 55*a* beneath the inserts 40, in a manner such that when walking, the projections 55*a* press against the inserts 40 and cushion the movement of the foot. The cooperation between projections 55*a* and inserts 40*a* on two different planes limits the effectiveness of the inserts 40, and complicates the structure of the shoe.

SUMMARY OF THE INVENTION

An object of the present invention is to improve the prior art.

Another object of the present invention is to obtain a shoe equipped with a sole which offers greater comfort with respect to the shoes of known type.

A further object of the present invention is to obtain a shoe equipped with a cushioning sole that can be made in a simple and economical manner.

Such objects are obtained by means of a sole equipped with cushioning elements of different shapes and sizes, positioned and oriented in a manner such that they follow a predetermined line.

The claims refer to preferred and advantageous embodiments of the invention.

BRIEF DESCRIPTION OF THE DRAWINGS

Further characteristics and advantages of the present invention will be clearer from the exemplifying description of several versions of shoes and cushioning capsules, illustrated as an example in the drawing set, in which.

DETAILED DESCRIPTION OF PREFERRED EMBODIMENTS

With reference to the attached figures, several soles 12 are shown of shoes 10, 50, 60 according to the present invention, comprising several base cushioning elements 20 in the form of internally-hollow capsules. Such capsules are provided for coming into contact with the ground, and are filled with a gel, a liquid, or another similar fluid material or granular material of substantially incompressible type.

Figure 1:
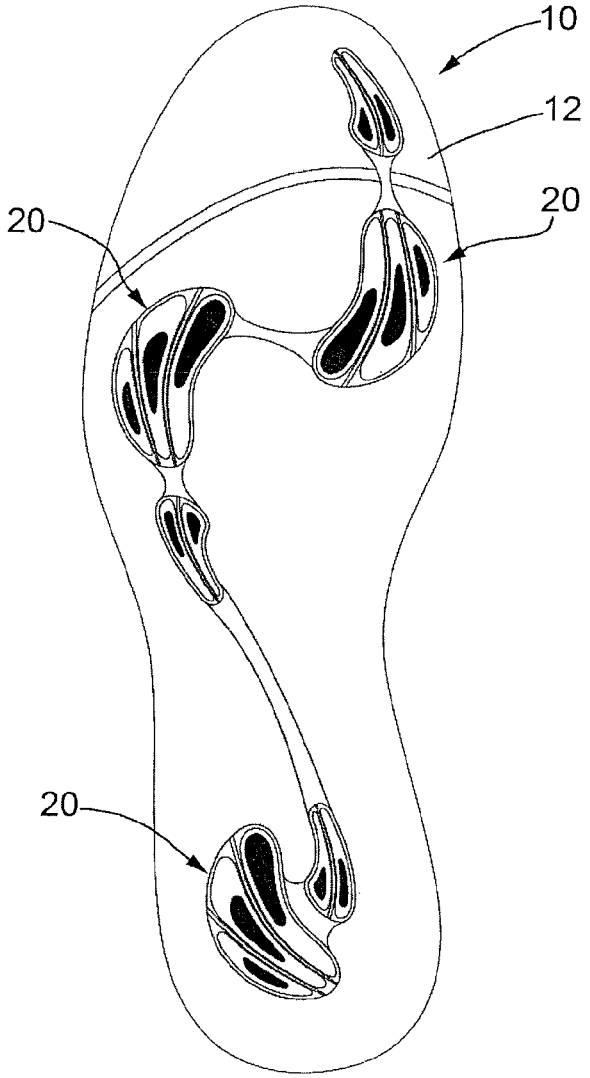
FIG. 1 shows a bottom view of a shoe using the modular system according to the present invention.

In the version of FIG. 1 of the present invention, a shoe 10 is illustrated with a sole 12 which comprises six cushioning elements 20 filled with gel or another similar incompressible material.

In such version, all the base cushioning elements 20 essentially have the same drop form, but some have different sizes and are inserted in the sole with a different positioning and orientation, considering, for example, an axis of the cushioning element 20 which starts from the widest part and leads towards the pointed part.

More specifically, the cushioning elements 20 are arranged in the sole 12 substantially along a non-rectilinear line 40.

Figure 28:
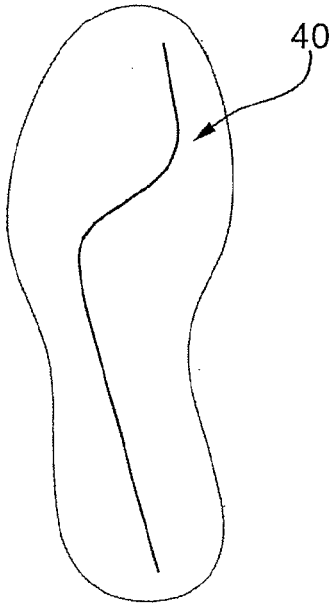
FIG. 28 shows a shoe sole with the indication of the line on which the weight of a person in transferred during walking.

According to a version of the present invention, such non-rectilinear line is the line on which the weight of a person is transferred during walking, i.e. along the so-called podalic line 40, illustrated as an example in FIG. 28, in a manner such that, sequentially from the heel towards the metatarsus, the cushioning elements 20 are compressed by the foot during walking.

In such a manner, micro-traumas are prevented and walking is much more comfortable due to the cushioning effect of the elements 20.

Due to the specific shapes and different sizes of the cushioning elements 20, it is possible to obtain, with a few elements, predetermined lines such as the podalic line 40.

Figure 2:
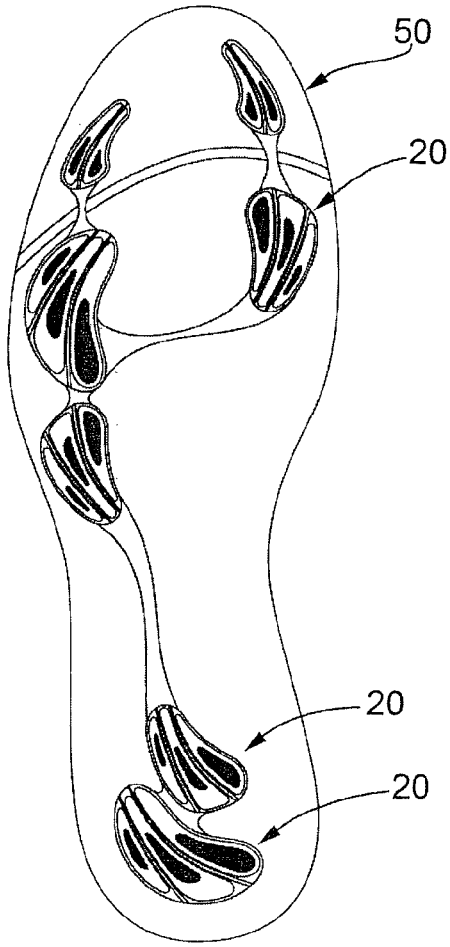
FIG. 2 shows a bottom view of another shoe version using the modular system according to the present invention.

FIG. 2 shows another sole 50, comprising a greater number of cushioning elements 20, and a different arrangement and orientation thereof. Such sole 50 can be provided for a more athletic shoe, adapted for supporting higher, even more dynamic loads.

The size, positioning and number of base cushioning elements in addition to characterizing the shoe type, whether athletic, leisure or street shoes, also defines the gender of the shoe itself: man, woman or child. It must also be observed that the cushioning elements 20 of the sole 50 are of three different sizes, all with substantially similar geometries. The cushioning element 20 of smaller size, also illustrated in the sole of FIG. 1, has a simplified geometry as will be better explained below.

Figure 3:
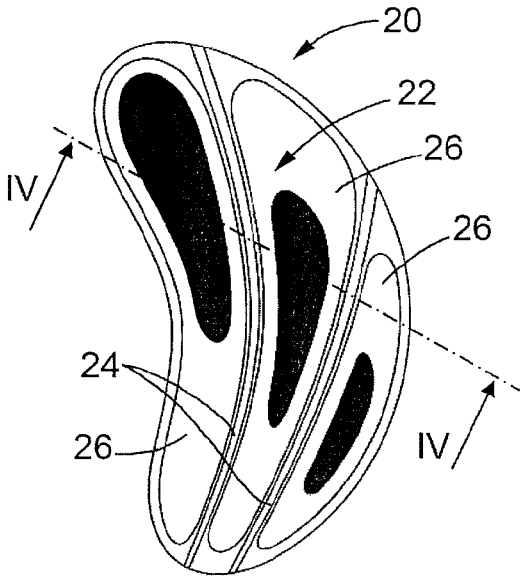
FIG. 3 shows a bottom view of a cushioning element according to the present invention.
Figure 4:
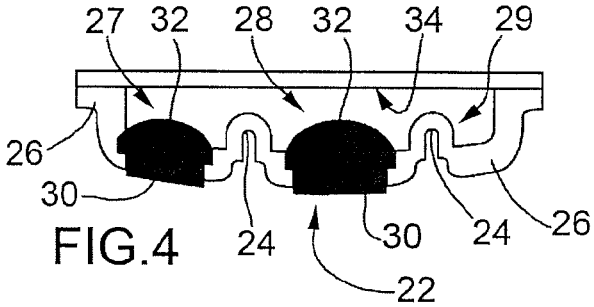
FIG. 4 shows, overturned, a section view along the IV-IV plane of the element of FIG. 3.
Figure 5:
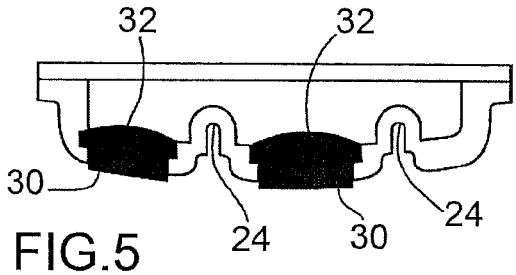
FIG. 5 shows, overturned, a section view along the IV-IV plane of the element of FIG. 3 according to another version of the present invention.
Figure 6:
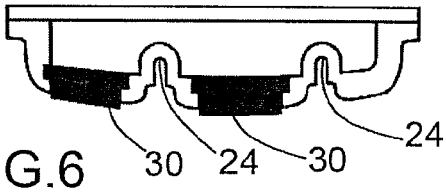
FIG. 6 shows, overturned, a section view along the IV-IV plane of the element of FIG. 3 according to a further version of the present invention.

In FIG. 3, a cushioning element of greater size in capsule form 20 is illustrated in detail; in FIG. 4 the section of the capsule of FIG. 3 is illustrated, while FIGS. 5 and 6 illustrate sections of other capsules of smaller size and/or for smaller loads.

The section of the capsule 20 has a bottom wall 26 which forms longitudinal folds 24 which are extended over the entire body of the capsule, from the pointed part towards the wider part.

The folds 24 define a certain number of chambers, e.g. three inner chambers 27, 28, 29 in communication with each other, so that the gel or the incompressible material of similar type can be moved following compression from one chamber to the other and/or enlarge the chambers by forcing the folds 24 outward and/or to the side, i.e. towards the ground and/or towards the sides of the shoe, improving the body load division effect during ground impact.

The wall 26 defines a lower abutment surface 22 for the capsule 20 substantially formed by the outward bending around the folds 24.

The capsules 20 shown in FIGS. 3-6 have two folds 24 and three chambers 27, 28 and 29, while the smaller-size capsule shown in the sole of FIGS. 1 and 2—and not shown in the section figures—has a single fold 24 and two chambers. The simplification is due to the smaller size and to the lower load absorption needs of this capsule.

The wall 26 also comprises inserts 30 made of different material from that which forms the wall 26. By means of the inserts 30, which can be constructed in fairly rigid material with respect to that of the wall 26, it is possible to adjust and vary the dynamic response of the capsule 20.

Furthermore, by selecting the material of the inserts 30 with suitable friction coefficient, it is also possible to increase the overall ground friction of the shoe.

The cushioning elements according to the present invention can comprise a covering made of thermoplastic material, e.g. thermoplastic polyurethane. The covering is then filled with the gel, or with the incompressible material of similar type, and then welded, e.g. by means of an ultrasound procedure.

The high friction coefficient material of the inserts can comprise an elastomer of natural or synthetic origin, or even thermoplastic elastomers or mixtures of these elastomers.

Another to other versions of the present invention illustrated in FIGS. 4 and 5, one or more inserts 30 can have a head or convexity 32 projecting towards the interior of the capsule 20 inside the chambers.

The head 32 can be fairly significant and has the function of end stop or stop pad against the upper inner surface 34 of the capsule 20, stopping the contraction of the latter when it is compressed by the weight of the foot.

FIGS. 4-6 illustrate the insert 30, with different heights of the head 32, with zero height limit (FIG. 6); such heights are also a function of the load to be supported, as provided for the capsule.

Hence, for example, the greater-size capsule with more significant head 32 can be provided for men's footwear, or for the largest shoe sizes; the capsule with intermediate size, with head 32 of intermediate height, can be provided for women's footwear, or for intermediate shoe sizes; and finally the smaller-size capsule with zero-height head 32 can be provided for children, or for the smallest shoe sizes.

Figure 7:
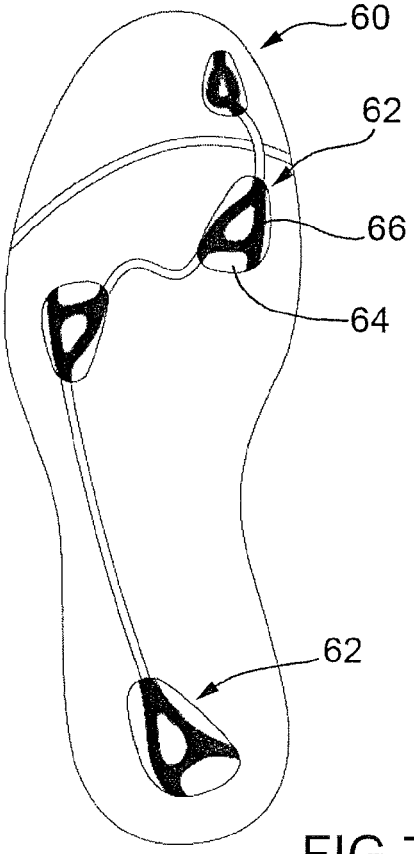
FIG. 7 shows a bottom view of another shoe version using the modular system according to the present invention.

FIG. 7 shows another sole 60 equipped with cushioning elements 62, with drop font and with different size and orientation.

They are arranged at different points of the podalic line, and they do not have folds: they are constituted by a flat or curved outer wall 64 in which an insert 66 is inserted, with the same concept described for the other inserts 30 of the capsules 20 of FIGS. 3-6.

Figure 9:
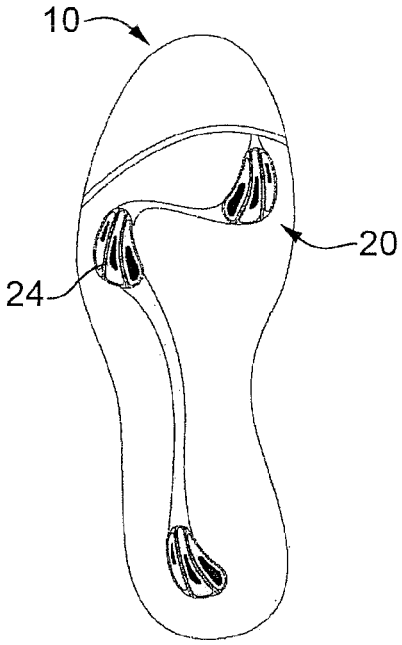
FIGS. 9-27 show, seen from below, further versions of cushioning elements and arrangements of cushioning elements in soles of shoes using the modular system according to the invention.
Figure 10:
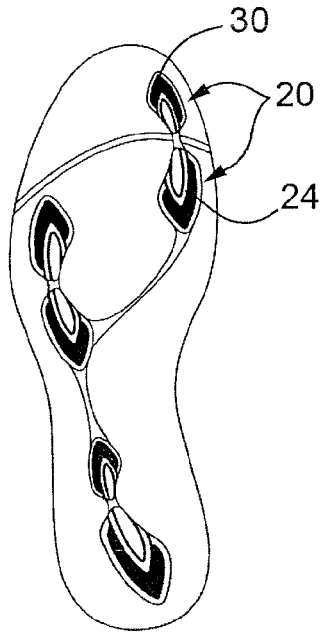
Figure 11:
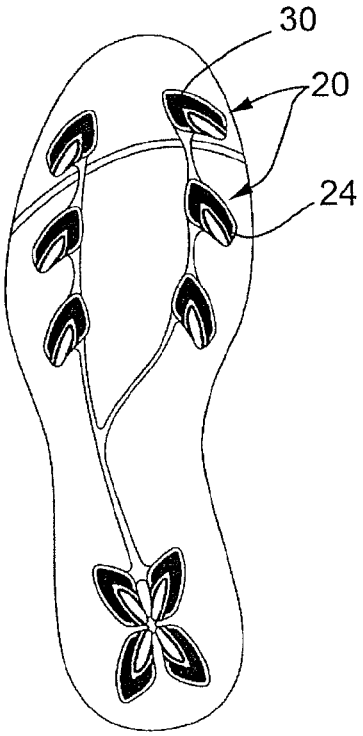
Figure 12:
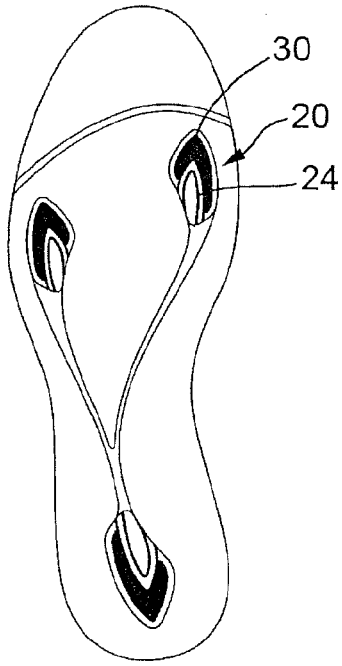
Figure 13:
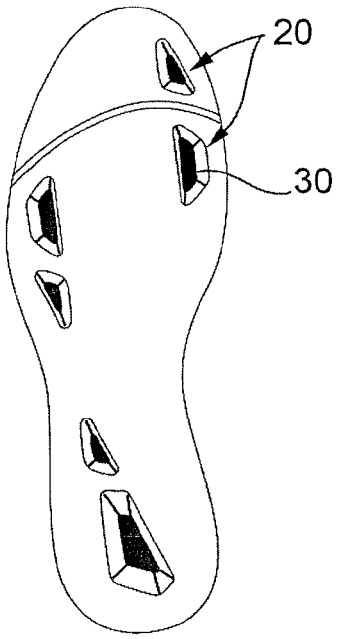
Figure 14:
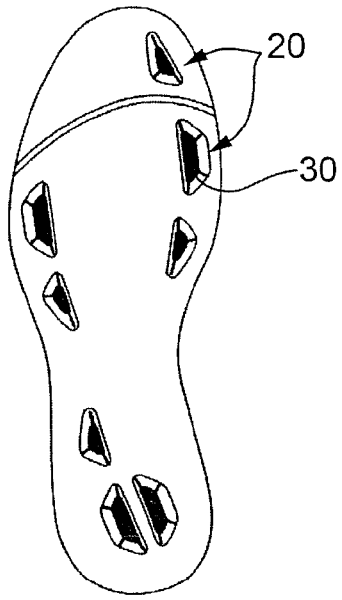
Figure 15:
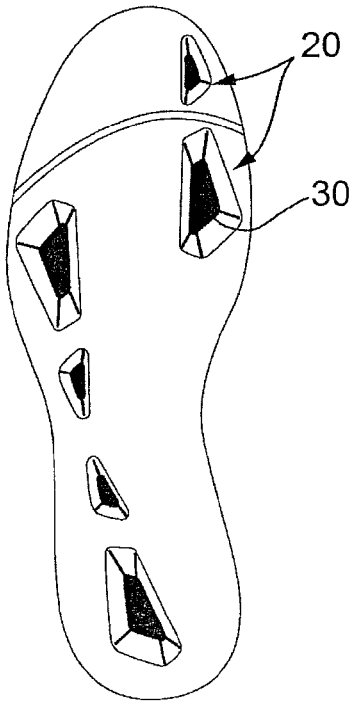
Figure 16:
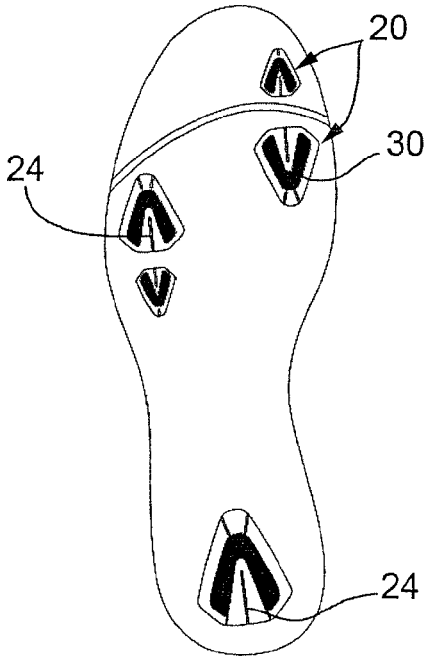
Figure 17:
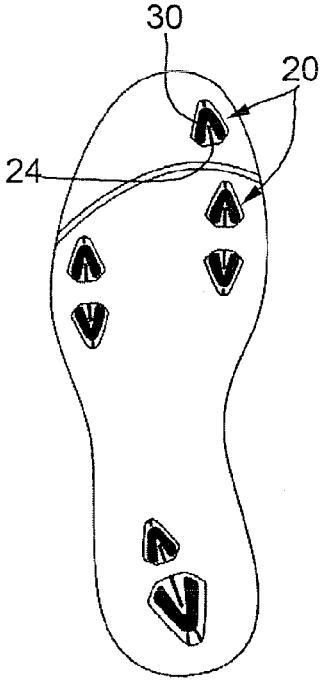
Figure 18:
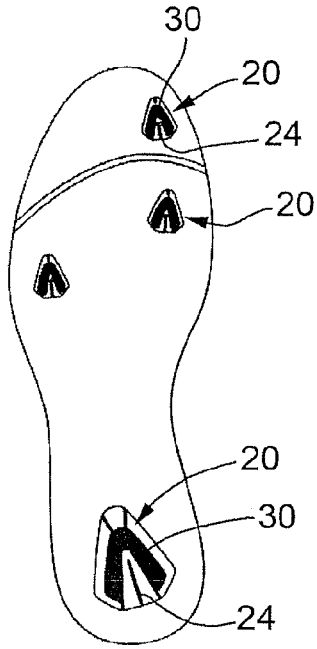
Figure 19:
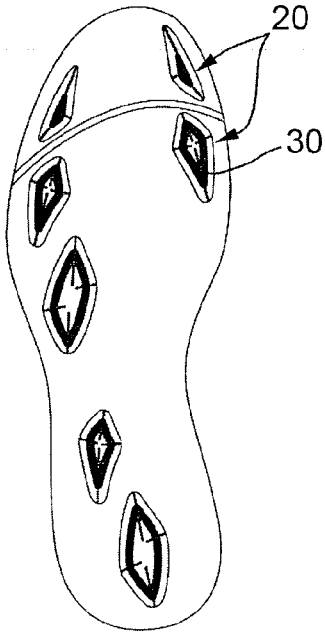
Figure 20:
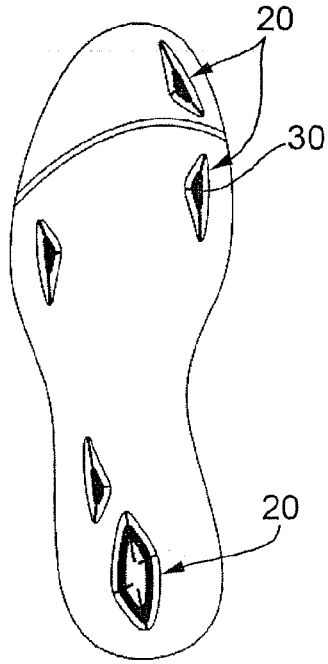
Figure 21:
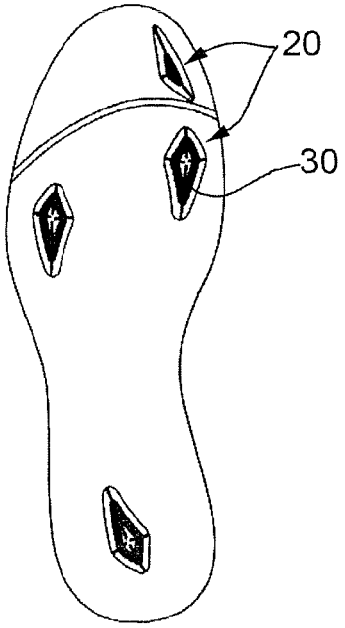
Figure 22:
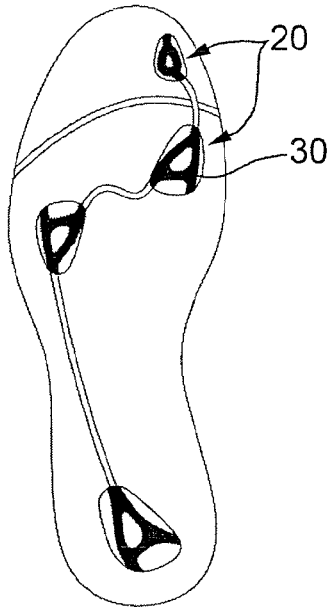
Figure 23:
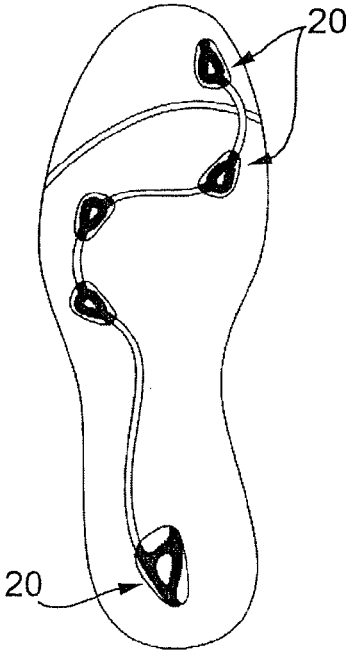
Figure 24:
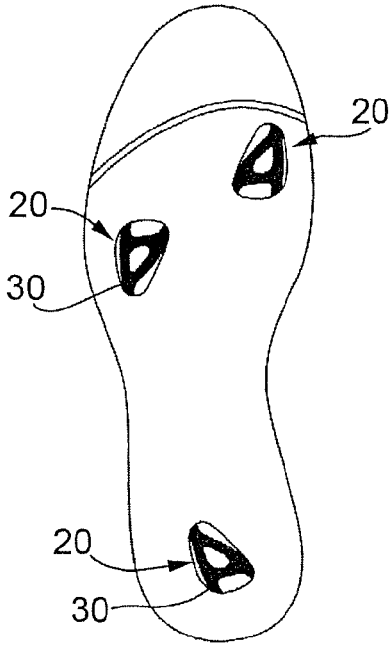
Figure 25:
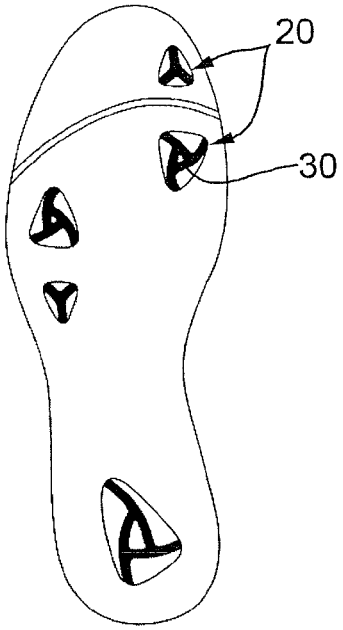
Figure 26:
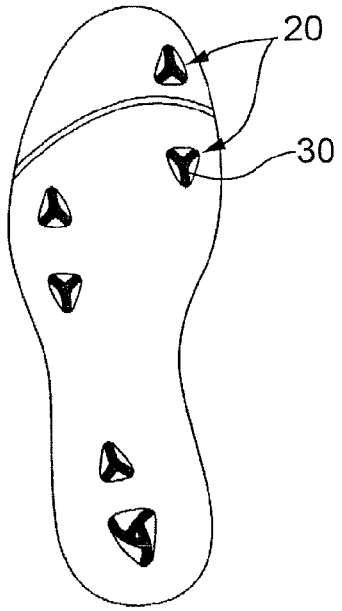
Figure 27:
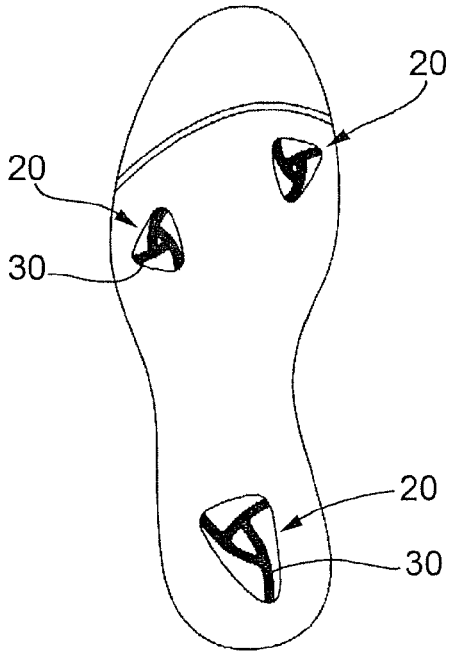

In FIG. 9, another arrangement embodiment is shown of the cushioning elements comprising drop-form capsules 20 in a sole 12 of a shoe 10.

In such sole 12, it can be observed that at least one cushioning element 20 is positioned near the heel of the user, at least another cushioning element 20 of smaller size than the first element is positioned near the first metatarsus, and at least a further cushioning element 20, still of smaller size than the first element, is positioned near the last metatarsus.

It is also observed that in such sole 12, the capsule 20 in the zone of the heel is preferably asymmetric, and in particular it is positioned, in an asymmetric manner, in the normal impact zone of the foot with the ground.

In FIGS. 10-27, other embodiments of other arrangements and orientation of the capsules 20 in shoe soles are illustrated. The capsules 20 can be with or without folds 24 and the inserts 30 can be differently designed.

For example, the capsules 20 can have different sizes and shapes: triangular, trapezoidal, rhomboid, arrow etc. Due to these different characteristics, it is therefore possible to adjust and vary the dynamic response and the comfort of the shoe, always considering that the preferred form is asymmetric in order to better favor the absorption of the load in the zone of the heel and the metatarsus.

The series of base cushioning elements 20 with geometrically similar shapes have different sizes with respect to each other. The base cushioning elements are adapted to achieve a modular system formed by capsules 20, and according to that illustrated in the above-described embodiments.

Such capsules 20, due to the different geometric shapes and sizes, can be inserted in the soles of shoes with arrangements and orientations adapted to define predetermined lines, and in particular they can define the line on which the weight of a person is transferred during walking.

With this modular system, by means of a few cushioning capsules 20, which constitute the base elements, i.e. the modules of the system, it is possible to adjust and vary the comfort and the dynamic response of the shoe.

Figure 8:
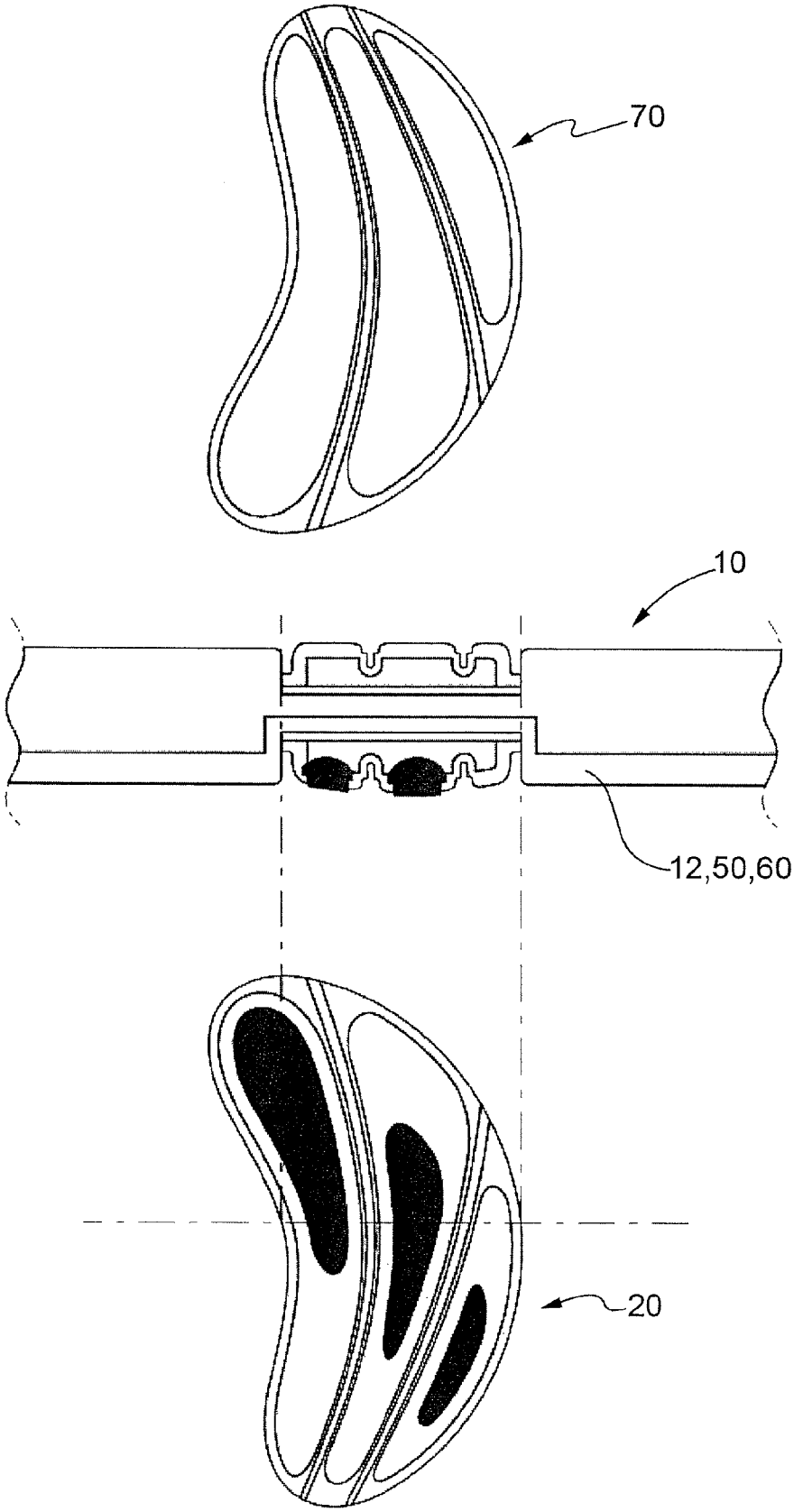
FIG. 8 shows a section of a sole in which a base cushioning element is used in several parts of a shoe using the modular system according to the present invention.

In FIG. 8, another version of the present invention is illustrated in which, inside the shoe 10, another capsule 70 is present. This capsule 70 is substantially similar to the capsule 20 present in the sole 12, 50, 60, and is with or without the inserts 30; only the latter version without inserts 30 is illustrated in FIG. 8.

The inner capsule 70 can be arranged substantially superimposed at an outer capsule 20, as illustrated in FIG. 8, or it can be arranged in a different manner, e.g. partially superimposed or in a different position with respect to the outer capsule 20 (the latter two versions are not illustrated).

In this manner, one obtains a greater pliability of the sole or of the insole and thus a greater overall comfort of the shoe.

The present invention thus conceived is susceptible to numerous modifications and variations, all coming within the protective scope of the claims.

The invention claimed is:

1. A shoe comprising cushioning means housed in a tread sole adapted to come into contact with the ground, wherein said cushioning means comprise a plurality of base cushioning elements, such cushioning elements being adapted to come into contact with the ground, and being positioned and oriented in a manner such that they follow a predetermined non-rectilinear line, wherein at least one of the base cushioning element comprises, on the surface which comes into contact with the ground, folds adapted to delimit projecting or outward-bending ground contact areas defining chambers inside the cushioning element, such chambers being in communication with each other along said folds, a fluid material or substantiality incompressible granular material present therein.

2. A shoe according to claim 1, wherein said predetermined line comprises a podalic line on which the weight of a person is transferred during walking.

3. A shoe according to claim 1, wherein said base cushioning elements have the form of internally-hollow capsules.

4. A shoe according to claim 1, wherein said base cushioning elements comprise geometric shapes and have different sizes.

5. A shoe according to claim 1, wherein said folds are extended from the widest part of the cushioning element to the narrowest part, crossing the entire cushioning element longitudinally.

6. A shoe according to claim 1, wherein at least one of the base cushioning element in one or each of said contact areas comprises an insert made of a different material from that of the base element adapted to contact the ground, the insert forming part of a lower wall of the base cushioning element.

7. A shoe according to claim 6, wherein said different material of said insert has a different friction coefficient with respect to the material that composes the base cushioning element.

8. A shoe according to claim 6, wherein the insert has a head projecting from the inner surface of the capsule, said head being adapted to come into abutment on the opposite inner surface of the capsule, so as to constitute an end stop or a stop pad of the inward deformation of the lower wall of the base cushioning element.

9. A shoe according to claim 1, comprising at least one cushioning element near the heel of the user, at least one other cushioning element of smaller size than a first cushioning element, near the first metatarsus, and at least one further cushioning element of smaller size than the first element near the last metatarsus.

10. A shoe according to claim 1, comprising at least one inner base cushioning element, said element being arranged substantially superimposed at an outer cushioning element.

11. A base cushioning element according to claim 1, further comprising a series of base cushioning elements, wherein said base cushioning elements are made with geometric shapes and with sizes having different ratios with respect to each other.

12. A shoe comprising cushioning means housed in a tread sole adapted to come into contact with the ground, wherein said cushioning means comprise a plurality of base cushioning elements, such cushioning elements being adapted to come into contact with the ground, and being positioned and oriented in a manner such that they follow a predetermined non-rectilinear line, wherein at least one of the base cushioning element comprises, on the surface which comes into contact with the ground, folds adapted to delimit projecting or outward-bending ground contact areas defining chambers inside the cushioning element, such chambers being in communication with each other, a fluid material or substantiality incompressible granular material present therein, wherein at least one of the base cushioning element in one or each of said contact areas comprises an insert made of a different material from that of the base element adapted to contact the ground, the insert forming part of a lower wall of the base cushioning element, wherein the insert has a head projecting from the inner surface of the capsule, said head being adapted to come into abutment on the opposite inner surface of the capsule, so as to constitute an end stop or a stop pad of the inward deformation of the lower wall of the base cushioning element.

13. A shoe according to claim 12, wherein said predetermined line comprises a podalic line on which the weight of a person is transferred during walking.

14. A shoe according to claim 12, wherein said base cushioning elements have the form of internally-hollow capsules.

15. A shoe according to claim 12, wherein said base cushioning elements comprise geometric shapes and have different sizes.

16. A shoe according to claim 12, wherein said folds are extended from the widest part of the cushioning element to the narrowest part, crossing the entire cushioning element longitudinally.

17. A shoe according to claim 12, wherein said different material of said insert has a different friction coefficient with respect to the material that composes the base cushioning element.

18. A shoe according to claim 12, comprising at least one cushioning element near the heel of the user, at least one other cushioning element of smaller size than a first cushioning element, near the first metatarsus, and at least one further cushioning element of smaller size than the first element near the last metatarsus.

19. A shoe according to claim 12, comprising at least one inner base cushioning element, said element being arranged substantially superimposed at an outer cushioning element.

* * * * *